US005407711A

United States Patent [19]

Lovison et al.

[11] Patent Number: 5,407,711

[45] Date of Patent: Apr. 18, 1995

[54] DISPLAY WITH ENHANCED HIGHLIGHTS

[75] Inventors: Douglas I. Lovison, Carlsbad; Lawrence J. Longobardi, Encinitas, both of Calif.

[73] Assignee: Signs & Glassworks, Incorporated, Vista, Calif.

[21] Appl. No.: 159,735

[22] Filed: Nov. 30, 1993

[51] Int. Cl.[6] ..... B44C 3/02

[52] U.S. Cl. ..... 428/13; 40/615; 283/94; 427/265; 428/912.2

[58] Field of Search ..... 428/38, 7, 13, 912.2; 40/615; 283/94; 427/265

[56] References Cited

U.S. PATENT DOCUMENTS

| | | | |
|---|---|---|---|
| 3,900,641 | 8/1975 | Woodman et al. | 428/38 |
| 3,931,425 | 1/1976 | Kuroda | 428/38 |
| 4,127,689 | 11/1978 | Holt | 428/38 |
| 4,791,010 | 12/1988 | Hanley et al. | 428/38 X |
| 4,933,218 | 6/1990 | Longobardi | 428/38 |
| 5,106,126 | 4/1992 | Longobardi et al. | 40/582 X |
| 5,223,357 | 6/1993 | Lovison | 430/1 |

*Primary Examiner*—Henry F. Epstein
*Attorney, Agent, or Firm*—Nydegger & Associates

[57] ABSTRACT

A display has a transparent plastic substrate and a colored image formed on the substrate. The colored image is formed on the substrate by process printing a large number of small dots, colored red, yellow, and blue, in a predetermined pattern onto the substrate. The red, yellow, and blue ink dots are translucent to visible light. A pattern of opaque white ink dots is process printed over selected portions of the image to highlight the selected portions and to thereby give the selected portions an appearance of relative depth. A reflective layer can be deposited against the ink patterns to reflect light which passes through the ink patterns and thereby give the image formed by the ink patterns a shiny, metallic appearance.

20 Claims, 2 Drawing Sheets

DISPLAY WITH ENHANCED HIGHLIGHTS

TECHNICAL FIELD

The present invention pertains generally to signs and other types of displays. More particularly, the present invention pertains to displays which can be used on trading cards, decals, packaging material, and the like. The present invention particularly, though not exclusively, pertains to process printed image displays that have portions of the displayed image enhanced to create the appearance of depth of view, to increase the effectiveness of the display.

BACKGROUND OF THE INVENTION

In the area of marketing, displays and designs have been widely used on many products to increase the appeal of the products and thereby make the products more attractive to potential purchasers. For example, fanciful displays and designs have been used on trading cards, greeting cards, packaging materials, labels, decals, and the like to enhance the appeal of these products.

Just one of the many types of displays which are commonly used are displays which have a transparent plastic substrate on which a design is formed. As can be readily appreciated, a large number of techniques exist for forming the desired design on a plastic substrate. Of particular importance to the present invention is the technique known as process printing, of which lithographic process printing and silk screen printing are well-known species.

In its most basic sense, process printing involves forming an image on a substrate by depositing a large number of very small, closely spaced colored dots onto the substrate. Each of the dots has one of the four primary colors, red, blue, yellow, or black. The desired image is formed on the substrate by particularly depositing the variously colored dots onto the substrate in a predetermined pattern, in a predetermined color combination. The pattern or combination in which the dots are deposited forms the desired image and also establishes the colors of the image.

Typically, when an image is to be formed on a plastic substrate for use as a card, label, packaging, and the like, the dots are translucent ink and are process printed onto the substrate. The image thus formed has a two-dimensional, flat appearance. It has been recognized that the effect of process printed displays can be enhanced by making portions of the display appear to be metallic and shiny, thereby giving the display a three-dimensional appearance. Displays of this type are disclosed in U.S. Pat. No. 5,106,126, issued to the present applicants. It has also been recognized that the effect of process printed displays can be enhanced by depositing a thick layer of ink on the substrate, to give the image an embossed or etched appearance. Displays of this type are disclosed in U.S. Pat. No. 4,933,218, issued to one of the present applicants. These patents are incorporated herein by reference.

The present invention recognizes that the effect of process printed displays can be enhanced by the deposition of a pattern of white ink dots over the pattern of colored ink dots, in varying densities, to highlight those areas and give the visual impression of depth to the image. An area of the image which receives a highlight pattern of a lesser density has the appearance of being relatively farther removed from the viewer. An area which receives a highlight pattern of a greater density has the appearance of being relatively closer to the viewer. The effect created by a display incorporating the present invention can be even further enhanced by outlining portions of the image with a thick layer of ink, or by placing a reflective layer over the image, as disclosed in the above cited patents.

Accordingly, it is an object of the present invention to provide a display which has a plastic substrate and a highlighted image process printed thereon. It is a further object of the present invention to provide a display which has a highlighted process printed image with portions of the image having a metallic, shiny appearance. Another object of the present invention is to provide a display which has diverse applications and which is cost effective to manufacture.

SUMMARY OF THE INVENTION

A display which can be used as a trading card, greeting card, label, decal, packaging material, or the like has a transparent plastic substrate, on which is formed a colored image. The image is formed by process printing a large number of relatively small, translucent, colored ink dots onto the substrate. In accordance with well-known process printing techniques, e.g. lithographic process printing and silk screen printing, the ink dots are colored black, yellow, blue, and red, and are deposited onto the substrate in a predetermined pattern to form the desired colored image.

Additionally, a highlight pattern of opaque white ink dots is deposited over selected portions of the image. This pattern of white ink can also be process printed in the form of a matrix of very small dots. The matrix can be more dense in some areas, and less dense in other areas. The range of density can range from approximately 1% to 100%. Still other areas may have no white ink pattern at all. Accordingly, those portions of the image which have white ink dots deposited thereon in a more dense matrix are more substantially opaque to visible light, and those areas will appear closer to the viewer. This is especially true where the layer of white ink is placed over a portion of the image which has no colored ink dots. On the other hand, those portions of the image which have white ink deposited thereon in a less dense matrix are more translucent to visible light, and those areas will appear farther from the viewer.

The image can also have portions outlined in a thick layer of ink to give an embossed or etched appearance. Additionally, a reflective layer can be deposited over the translucent colored ink dots and white ink dots which form the printed image. This reflective layer serves to reflect light which passes through the translucent portions of the image, thereby giving the translucent portions of the image, whether highlighted or not, a shiny, metallic appearance.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
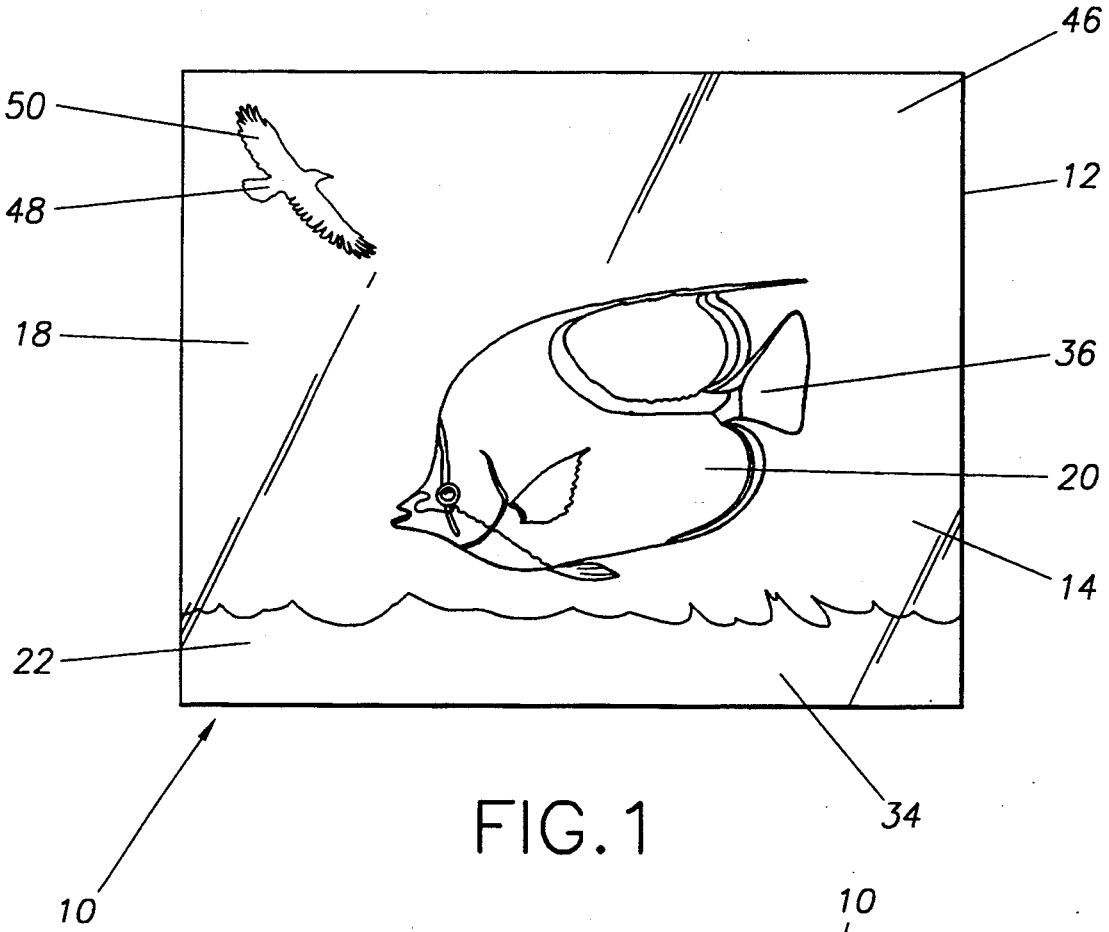
FIG. 1 is an elevation view of a display embodying the present invention.

Referring initially to FIG. 1, a display is shown and generally designated 10. Display 10 includes a transparent substrate 12. Substrate 12 can be a plastic sheet or a glass pane, and furthermore can be tinted or clear. In any event, substrate 12 must permit the passage of selected wavelengths of light in the visible spectrum through substrate 12. Finally, substrate 12 also has a first surface 14 and a second surface 16, best shown in FIG. 4.

FIG. 1 also shows that substrate 12 can have any desirable image 18 printed thereon, such as the fish 20 jumping over the waves 22, with the bird 48 flying by. As seen in cross-reference to FIGS. 1 and 4, image 18 is formed on substrate 12 by depositing an image pattern 24 of ink onto side 16 of substrate 12.

The ink which is used for image pattern 24 is relatively viscous and is curable within a relatively short period of time (e.g. six seconds). More specifically, it is preferred that the ink be curable with ultraviolet (UV) light. Further, the ink should be relatively viscous, such as any of the enamel, epoxy and acrylic inks which are well known in the art. Also, it is to be appreciated that the ink which forms predetermined portions of image pattern 24 may be translucent, while the ink that forms other predetermined portions of image pattern 24 may be opaque.

Figure 4:
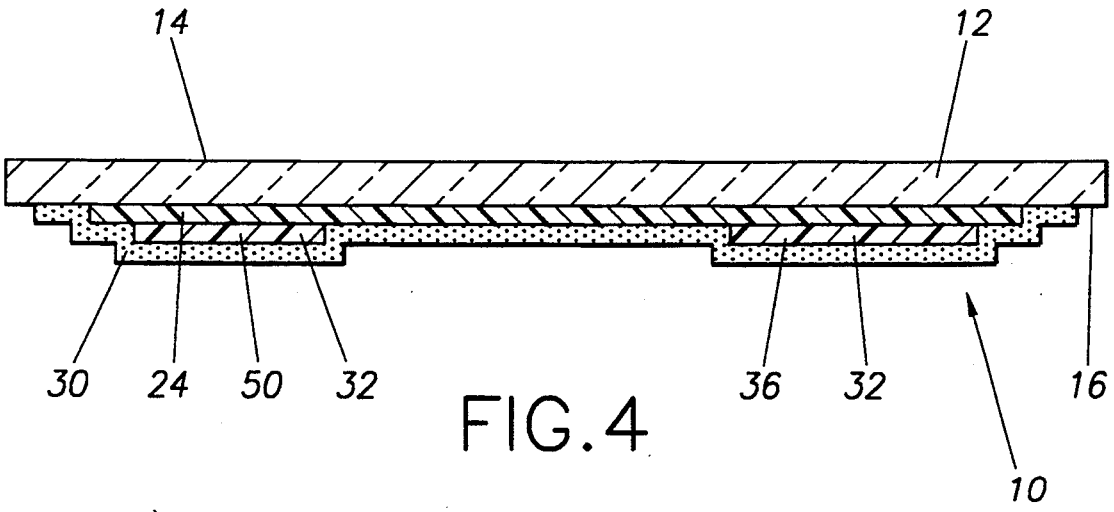
FIG. 4 is a section view of the display shown in FIG. 1.

It may be desirable to make certain portions of image 18 appear to be relatively closer to the viewer, and to make other portions of image 18 appear to be relatively farther from the viewer. If so desired, light which passes through selected portions of image 18, which are to appear relatively more or less distant from the viewer, may be partially blocked to varying degrees by covering the selected portions with a second pattern of ink dots. Preferably, the entire image pattern 24 is translucent, and a highlight pattern 32 of non-shiny opaque ink, shown in FIG. 4, is deposited over the selected portions of image 18 which are to be given the appearance of being relatively more or less distant from the viewer. This highlights these portions to varying degrees.

Figure 2:
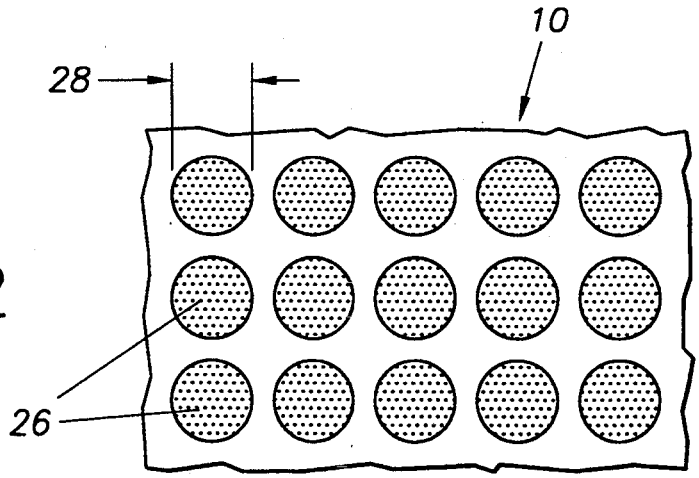
FIG. 2 is a cutaway view of a portion of the display shown in FIG. 1, showing a relatively more dense pattern of ink dots, in close-up.
Figure 3:
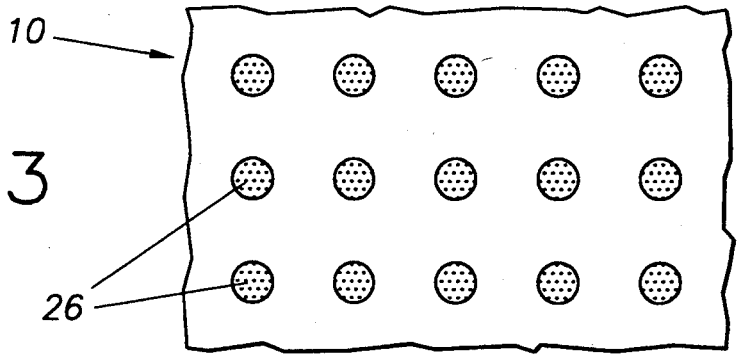
FIG. 3 is a cutaway view of a portion of the display shown in FIG. 1, showing a relatively less dense pattern of ink dots, in close-up.

As shown in FIGS. 2 and 3, the ink which forms image pattern 24 or highlight pattern 32 is deposited as a plurality of closely spaced ink dots 26. Ink dots 26 are deposited by any suitable method of process printing, for example lithographic process printing or silk screen printing. As is well known in the art, the dots 26 which are printed as image pattern 24 are yellow, black, blue, and red, although other colors may potentially be used. In forming image pattern 24, dots 26 are deposited in a predetermined color combination which establishes both the shape and color of image 18. It is to be appreciated that the diameter 28 of the dots 26 can be varied, in order to establish a desired density of deposition of the ink. For example, when using the well known silk screen process printing, a given screen density can be specified between approximately 15% and 100%. On the other hand, when using lithographic process printing, the diameter 28 of dots 26 can be established to be as small as industrially useful. FIG. 2 represents a density greater than the density represented in FIG. 3.

In the preferred embodiment, highlight pattern 32 is a layer of white ink which is process printed onto the selected portions of image 18. Selected portions of highlight pattern 32 will be deposited more densely, as demonstrated in FIG. 2, and other portions will be deposited less densely, as demonstrated in FIG. 3. The portions of image 18 upon which highlight pattern 32 is more densely deposited will appear to be closer to the viewer. The portions of image 18 upon which highlight pattern 32 is less densely deposited will appear to be farther from the viewer.

To illustrate, as shown in cross-reference to FIGS. 1 and 4, no highlight pattern 32 is deposited on the portions 34 and 46 of image pattern 24, which form the water and sky portions of image 18. In this example, it is not desired to give these portions the appearance of being closer to or farther from the viewer. On the other hand, as seen in cross-reference to FIGS. 1 through 4, it is desired to make the fish 20 appear closer to the viewer and to make the bird 48 appear farther away. Therefore, highlight pattern 32 is deposited over portion 36 of image pattern 24, which forms the fish 20, and over portion 50, which forms the bird 48. Consequently, light which passes through portions 36 and 50 will be at least partially blocked by opaque stratum 32.

The portion of highlight pattern 32 which covers portion 36 will be deposited more densely, as demonstrated in FIG. 2, while the portion which covers portion 50 will be deposited less densely, as demonstrated in FIG. 3. This will give the fish 20 the appearance of being relatively closer to the viewer than the bird 48. Highlight pattern 32 can also be applied to portions of image 18 not covered by image pattern 24, to make those portions appear relatively more or less distant from the viewer. A density of 100% can be used to make the portion of the image appear closest to the viewer, and progressively less dense degrees of deposition can be used to give a progressively more distant appearance.

Referring to FIG. 4, a reflective layer 30 is shown deposited against image pattern 24 and highlight pattern 32. Furthermore, FIG. 4 shows that reflective layer 30 can be deposited against portions of side 16 of substrate 12 which are not covered by image pattern 24. It is to be understood, however, that reflective layer 30 need only be deposited against selected portions of image 18 which are to appear metallic.

In the preferred embodiment, reflective layer 30 is a sheet of metalized mylar which is laminated onto image pattern 24, highlight pattern 32, and side 16 of substrate 12. Alternatively, reflective layer 30 can be a layer of metallic paint or ink which is deposited by spraying. Reflective layer 30 can even be a layer of metallic ink or paint which is deposited by dipping side 16 of substrate 12 (and, hence, image pattern 24 and highlight pattern 32) into a container of the metallic paint or ink which is to form reflective layer 30.

METHOD OF MANUFACTURE

Figure 5:
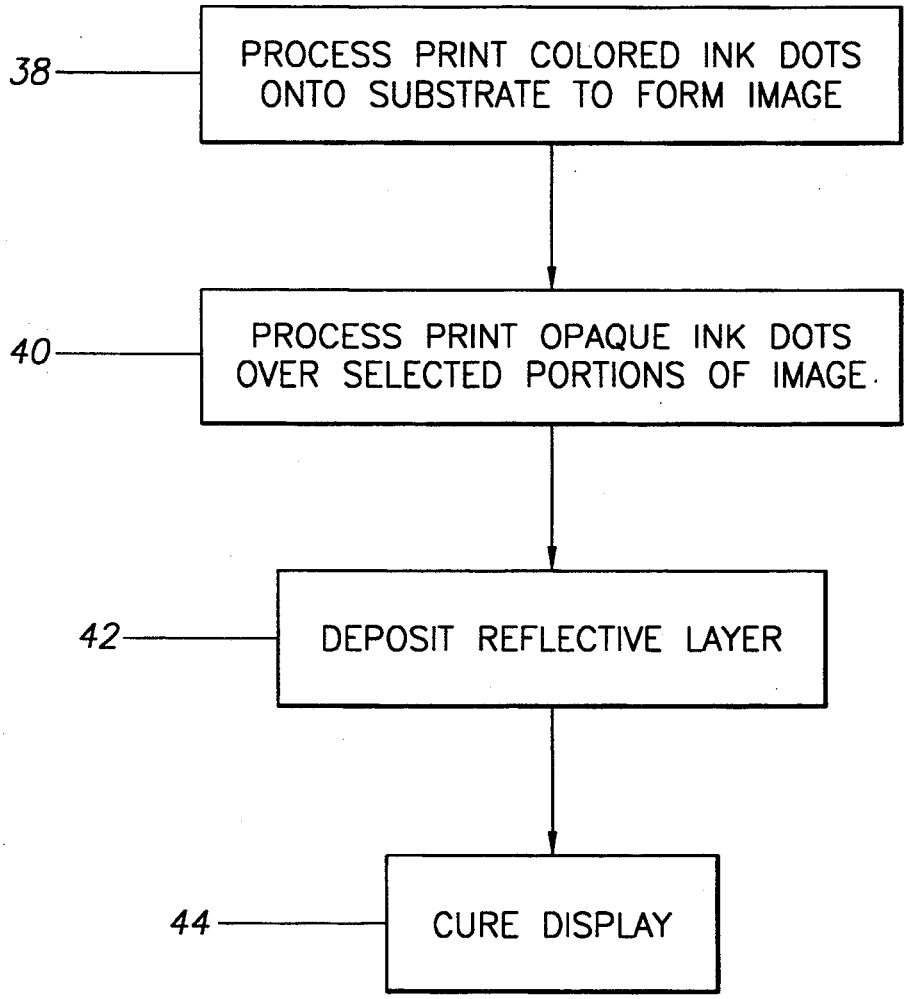
FIG. 5 is a block diagram of the method of manufacturing the display of the present invention.

In the method of manufacturing display 10, reference is made to FIG. 5. In accordance with well known methods of process printing, including silk screening and lithographic process printing, a large number of relatively small, closely spaced colored dots 26 are deposited onto side 16 of substrate 12, shown in FIG. 4, to form image pattern 24. This depositing step is indicated at block 38 in FIG. 5. Typically, each dot 26 will be a red, yellow, or blue translucent ink dot. The variously colored dots 26 are deposited onto substrate 12 in a predetermined combination, in accordance with well known methods of process printing, to form the image 18 shown in FIG. 1.

Next, at block 40, a suitable highlight pattern 32 of opaque ink dots 26, for example opaque white ink, is deposited over selected portions of image pattern 24 (e.g., portions 36 and 50) which form those portions of image 18 (e.g., fish 20 and bird 48) that are intended to appear relatively more or less distant from the viewer. Stratum 32 may be process printed over portions 36 and 50 in accordance with well known techniques.

Next, as shown at block 42 of FIG. 5, reflective layer 30 is deposited against portions of image pattern 24 and highlight pattern 32 which form portions of image 18 that are intended to appear metallic. As seen in FIG. 4, however, reflective layer 30 may additionally be deposited against portions of side 16 of substrate 12 which are not covered by image pattern 24. In any case, reflective layer 30 is preferably a metalized mylar sheet. The mylar sheet which constitutes reflective layer 30 can be laminated or glued on. Or, reflective layer 30 may be a layer of metallic paint which can be sprayed or printed on. Layer 30 in the form of metallic paint can even be deposited by gently dipping side 16 of substrate 12 into a container (not shown) of the metallic paint. Display 10 is subsequently cured, for example by exposing display 10 to ultraviolet light, at block 44.

While a particular process printed image with highlighted areas as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. A display, comprising:

a transparent substrate;

a translucent first pattern of colored ink deposited on a surface of said substrate, to form an image; and a second pattern of opaque ink dots deposited in a selected area of said image;

wherein said opaque ink dots are deposited at a selected density to create the appearance of a desired depth in said selected area of said image.

2. A display as claimed in claim 1, wherein said first pattern of colored ink comprises a matrix of dots.

3. A display as claimed in claim 1, wherein said opaque ink dots are white.

4. A display as claimed in claim 1, wherein at least a portion of said second pattern of opaque ink dots is deposited over at least a portion of said first pattern of colored ink.

5. A display as claimed in claim 1, wherein at least a portion of said second pattern of opaque ink dots is deposited over at least a portion of said image not occupied by said first pattern of colored ink.

6. A display as claimed in claim 1, wherein said selected density is relatively low, thereby creating the impression of a relatively greater depth in said selected area of said image.

7. A display as claimed in claim 1, wherein said selected density is relatively high, thereby creating the impression of a relatively lesser depth in said selected area of said image.

8. A display as claimed in claim 1, further comprising a reflective layer deposited against said first and second patterns of ink to reflect light through said first and second patterns, thereby giving a shiny appearance to said image, wherein said appearance is relatively less shiny in any area covered by said second pattern, and relatively more shiny in any area not covered by said second pattern.

9. A display, comprising:

a transparent substrate;

a first pattern of colored ink dots deposited on a surface of said substrate, to form an image; and a second pattern of opaque ink dots deposited in a plurality of areas of said image;

wherein said opaque ink dots in a first of said areas of said image are deposited at a first, relatively higher density, to create the appearance of a first relatively lesser depth in said first area; and wherein said opaque ink dots in a second of said areas of said image are deposited at a second, relatively lower density , to create the appearance of a second relatively greater depth in said second area.

10. A display as claimed in claim 9, wherein said opaque ink dots are white.

11. A display as claimed in claim 9, wherein at least a portion of said second pattern of opaque ink dots is deposited over at least a portion of said first pattern of colored ink dots.

12. A display as claimed in claim 9, wherein at least a portion of said second pattern of opaque ink dots is deposited over at least a portion of said image not occupied by said first pattern of colored ink dots.

13. A display as claimed in claim 9, further comprising a reflective layer deposited against said first and second patterns of ink dots to reflect light through said first and second patterns, thereby giving a shiny appearance to said image, wherein said appearance is relatively less shiny in any area where said opaque ink dots are relatively more densely deposited, and relatively more shiny in any area where said opaque ink dots are relatively less densely deposited.

14. A display as claimed in claim 9, wherein:

said first density in said first area results in approximately fifty percent coverage of said first area by said opaque ink; and said second density in said second area results in approximately fifteen percent coverage of said second area by said opaque ink.

15. A method of making a display of an image which gives the impression of a first relatively lesser depth in a first selected area of said image and a second relatively greater depth in a second selected area of said image, comprising the steps of:

providing a transparent substrate;

placing a first pattern of colored ink dots on said substrate to form an image; and placing a second pattern of opaque ink dots over at least one selected area of said image, with said dots deposited at a selected density to create the appearance of a desired depth in said selected area of said image.

16. A method of making a display of an image, as claimed in claim 15, wherein:

said second pattern of opaque ink dots includes a first selected area where said dots are deposited at a relatively high first density, to create the appearance of a first relatively lesser depth in said first area; and said second pattern of opaque ink dots includes a second selected area where said dots are deposited at a relatively low second density, to create the appearance of a second relatively greater depth in said second area.

17. A method of making a display of an image, as claimed in claim 15, wherein said opaque ink dots are white.

18. A method of making a display of am image, as claimed in claim 15, wherein at least a portion of said second pattern of opaque ink dots is deposited over at least a portion of said first pattern of colored ink dots.

19. A method of making a display of an image, as claimed in claim 15, wherein at least a portion of said second pattern of opaque ink dots is deposited over at least a portion of said image not occupied by said first pattern of colored ink dots.

20. A method of making a display of an image, as claimed in claim 15, further comprising the step of depositing a reflective layer against said first and second patterns of ink dots to reflect light through said first and second patterns, thereby giving a shiny appearance to said image, wherein said appearance is relatively less shiny in any area covered by said second pattern, and relatively more shiny in any area not covered by said second pattern.

* * * * *